United States Patent [19]

Tetherton

[11] Patent Number: 5,072,543

[45] Date of Patent: Dec. 17, 1991

[54] TURNSTILE MECHANISM

[75] Inventor: Cyril F. Tetherton, Poway, Calif.

[73] Assignee: Cubic Automatic Revenue Collection Group, San Diego, Calif.

[21] Appl. No.: 633,451

[22] Filed: Dec. 19, 1990

[51] Int. Cl.[5] ..... E06B 11/08

[52] U.S. Cl. ..... 49/47

[58] Field of Search ..... 49/47, 46

[56] References Cited

U.S. PATENT DOCUMENTS

| | | | |
|---|---|---|---|
| 2,144,718 | 1/1939 | Gersbach | 49/47 |
| 2,714,264 | 8/1955 | Odell | 49/47 X |
| 3,978,613 | 9/1976 | Hayward et al. | 49/47 X |
| 3,998,008 | 12/1976 | Collins | 49/47 |

FOREIGN PATENT DOCUMENTS

| | | | |
|---|---|---|---|
| 822562 | 9/1937 | France | 49/47 |

*Primary Examiner*—Philip C. Kannan

*Attorney, Agent, or Firm*—Gregory O. Garmong

[57] ABSTRACT

A turnstile is made with a stationary turnstile support shaft extending from a solid support, and a bearing on the end of the shaft. The turnstile hub is supported on the end of the shaft with a bearing. The turnstile hub is locked against rotation in a fee-paid direction by a unidirectional pawl that engages a cutout on a ratchet plate attached to the hub. The unidirectional pawl is released by energizing a solenoid latching mechanism, rather than acting directly on the unidirectional pawl. Backcocking of the turnstile is prevented by a bidirectional pawl that engages notches on the ratchet plate. The bidirectional pawl is released by energizing a second solenoid latching mechanism, rather than acting directly on the bidirectional pawl.

15 Claims, 2 Drawing Sheets

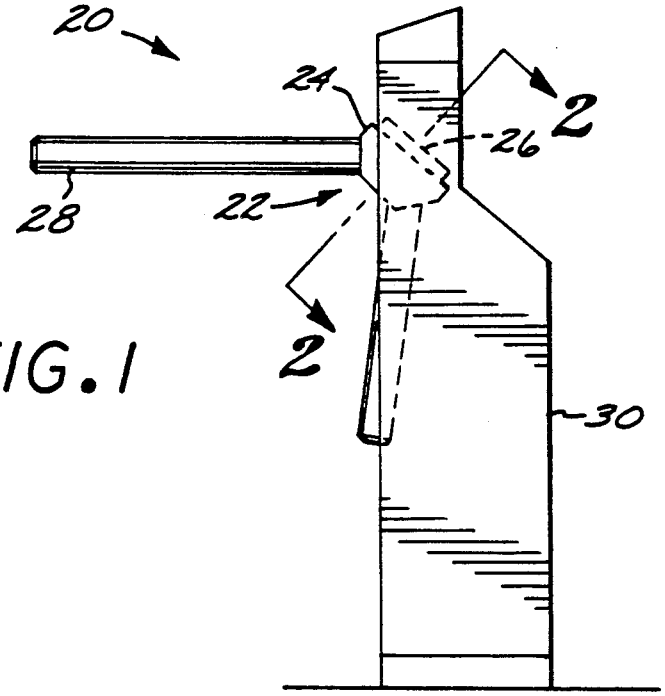
FIG. 1
FIG. 2
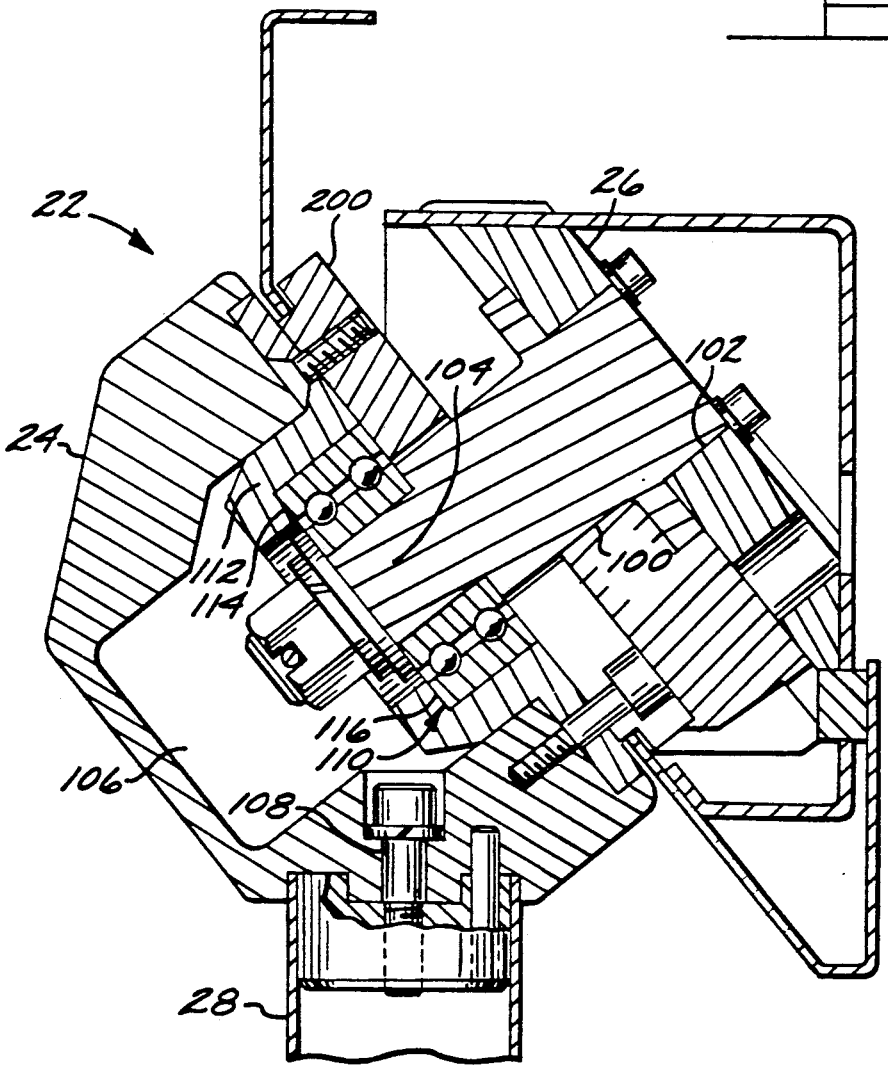

TURNSTILE MECHANISM

BACKGROUND OF THE INVENTION

This invention relates to the mechanism of a turnstile in a mass transit system, and, more particularly, to such a mechanism that is operable in a wide variety of conditions.

To gain admission to the fee-paid area of a mass transit station, the patron typically pays a fee and enters through some type of barrier. The barrier is normally locked until the fee is paid, and then is either unlocked or unlocked and opened responsive to the payment of the entry fee, so that the patron may enter through the passageway. The barrier is typically structured so that persons may leave the fee-paid area through the same passageway.

The most common type of barrier is a turnstile, which is a rotatable hub having arms extending therefrom. One of the arms extends across the passageway when the turnstile is at rest in its "home" position. When the fee is paid, the turnstile is unlocked, so that the patron can cause the turnstile hub to rotate in a fee-paid direction by pushing against it with the body or arms. Some turnstiles are supplied with a motor or an energy storage mechanism to assist in the turning of the turnstile hub. The control system or energy storage mechanism of the turnstile is usually arranged so that, after the patron passes through in the fee-paid direction, the next of the arms is positioned to block the passageway. This movement aids in the singulation function, ensuring that only one person can move through the passageway with each fee paid. The turnstile mechanism is also structured to permit persons to exit from the fee-paid area without the payment of a fee, by pushing against the arms to rotate the turnstile hub in the opposite direction.

The mass transit patron typically does not take time to read detailed instructions as to the proper operation of the turnstile, as its use is fairly self evident. However, the patron may unknowingly use the turnstile in a manner that is hard on its mechanism. For example, the patron may lean heavily against the turnstile arm as the payment is inserted into the fare-collection device and the arm and hub are unlocked. This sideways force on the arm may tend to jam or at least prevent the unlocking mechanism from working properly. To ensure unlocking upon demand, powerful unlocking solenoids are typically provided in turnstile mechanisms.

The turnstile system is contacted by each paying customer at least once, and twice if exit is achieved through the turnstile. Additionally, those persons who would attempt to enter the fee-paid area but defeat the fare-collection system encounter the turnstile. One strategy, termed backcocking, to avoid payment is to manually rotate the turnstile hub a short distance in the exit direction so that there is created some additional space between the arms and the adjacent cabinet and to squeeze past the arms.

Since the turnstile is accessible to virtually everyone in the public, the turnstile system is also subject to vandalism. Much of the turnstile mechanism is enclosed in a cabinet housing, leaving the turnstile arms and hub as the most vulnerable components. It is not uncommon for vandals to smash heavy objects against the turnstile, either to gain entry or simply to be destructive. As an example, a person weighing over 200 pounds may jump onto the arm or push against the arm, and in some cases two people may work together to damage the arm or hub mechanism.

In short, the turnstile arms, hub, and mechanism generally can be subjected to demanding conditions by regular patrons, those attempting to use the system but avoid payment, and vandals. The turnstile is operated in a high volume of usage, and it must therefore be able to function for long times between failures while tolerating occasional abuse. The turnstile must retain its smooth, predictable mode of operation through all of these conditions.

A good deal of engineering effort has been directed to the development of turnstile mechanisms, and generally satisfactory units are available commercially. There exists an ongoing need to improve the mechanisms, however. Some remaining areas for improvement are to reduce the susceptibility of the mechanism to damage from loadings of up to 1000 pounds on the arms or hub, reduce the incidence of jamming as a result of loading the arms during operation of the unlocking mechanism, and reduce accessibility of the system to persons who employ sophisticated strategies to gain entrance without payment. Another consideration is that there is an ongoing need to reduce the cost and increase the mean time between failures of the mechanism by making it more rugged. Finally, some transit systems now require that the turnstile be operable for some period of time in a low-power mode on a battery, and the mechanism must consume low levels to meet this requirement. The present invention provides an improved turnstile mechanism meeting these needs, and further provides related advantages.

SUMMARY OF THE INVENTION

The present invention provides an improved turnstile mechanism that meets conventional requirements such as controlled unlockable operation in the fee-paid direction to permit singulated admission of patrons to the fee-paid area, and free wheeling in the exit direction to permit persons to exit from the fee-paid area rapidly and without payment. The mechanism is highly resistant to damage and interference with normal operation by external loadings to the arms and hub. It is fully operable with low power consumption.

In accordance with the invention, a turnstile mechanism comprises a turnstile support; a turnstile hub having an interior cavity and turnstile arms extending therefrom; a stationary turnstile support shaft fixed to the turnstile support and having a support end extending into the turnstile hub cavity; and a bearing on the support end of the turnstile support shaft and disposed within the turnstile hub cavity, the bearing acting to support the turnstile hub from the stationary support shaft.

This design for supporting the hub permits the use of a large diameter, rugged support shaft, and, equally importantly, the use of a large diameter, rugged bearing between the shaft and the turnstile hub. The bearing is located at the hub, reducing the bending moments on the bearing when external loads are applied to the hub or the arms.

In another aspect of the invention, a turnstile mechanism comprises a turnstile hub support; a turnstile hub having turnstile arms extending therefrom; means for rotationally supporting the turnstile hub from the turnstile hub support; a ratchet plate mounted to the turnstile hub, the periphery of the ratchet plate being divided into segments having a rotational symmetry corresponding to the number of turnstile arms with a home position for each segment, the periphery of the ratchet plate further having, within each segment, a unidirectional pawl engagement cutout; and means for locking the turnstile hub against rotation in a fee-paid direction and for controllably unlocking the turnstile hub to permit the turnstile hub to rotate in a fee-paid direction, the means for unlocking and for controllably unlocking including a unidirectional pawl movable between a first unidirectional pawl position wherein the unidirectional pawl engages the unidirectional pawl engagement cutout of the ratchet plate when the turnstile hub is in the home position, and a second unidirectional pawl position wherein the unidirectional pawl does not engage the unidirectional pawl engagement cutout of the ratchet plate, means for biasing the unidirectional pawl toward the first unidirectional pawl position, a drive arm movable from a first drive arm position wherein the drive arm permits the unidirectional pawl to remain at the first unidirectional pawl position, and a second drive arm position wherein the drive arm urges the unidirectional pawl toward the second unidirectional pawl position, and means for biasing the drive arm toward the second drive arm position, the force exerted by the drive arm acting upon the unidirectional pawl being greater than the force exerted by the means for biasing the unidirectional pawl; and latching means for retaining the drive arm in the first drive arm position and for controllably unlatching the drive arm to permit it to move toward the second drive arm position.

This design separates the locking function of the unidirectional pawl from the releasing function that is accomplished by the latching means. The unidirectional pawl and its support can therefore be made strong and resistant to damage. Loading and impact forces applied to the unidirectional pawl through the hub are not transmitted to the latching mechanism. The latching mechanism can therefore include a relatively small solenoid controllable by a fee-receiving mechanism or an operator, to activate the unlatching function. The small solenoid consumes little power, and is therefore ideal for battery-powered operation.

In another aspect of the invention, a turnstile mechanism comprises a turnstile support; a turnstile hub having turnstile arms extending therefrom; means for rotationally supporting the turnstile hub from the turnstile support; a ratchet plate mounted to the turnstile hub, the periphery of the ratchet plate being divided into segments having a rotational symmetry corresponding to the number of turnstile arms with a home position for each segment, the periphery of the ratchet plate further having, within each segment, at least one bidirectional pawl engagement notch; means for biasing the turnstile hub toward a home position; means for locking the turnstile hub against backcocking in an exit direction and for controllably unlocking the turnstile hub to permit the turnstile hub to move toward a home position, the means for locking and for controllably unlocking including a bidirectional pawl movable between a first bidirectional pawl position wherein the bidirectional pawl does not engage one of the notches and a second bidirectional pawl position wherein the bidirectional pawl engages one of the notches, a zeroing drive arm movable between a first zeroing drive arm position wherein the zeroing drive arm does not engage the bidirectional pawl and a second zeroing drive arm position wherein the zeroing drive arm engages the bidirectional pawl to urge it toward the second bidirectional pawl position, and means for biasing the zeroing drive arm toward the second zeroing drive arm position; and latching means for retaining the zeroing drive arm in the first zeroing drive arm position and for controllably unlatching the zeroing drive arm to permit it to move toward the second zeroing drive arm position.

The automatic zeroing function of this aspect of the invention permits the bidirectional pawl to interact with the ratchet plate to prevent defeat of the turnstile mechanism by backcocking. Additionally, the bidirectional pawl can be controllably released from engagement with the ratchet plate, through a low-power solenoid, when it is desirable to release the anti-backcocking protection and return the turnstile hub to the home position.

The present turnstile mechanism therefore provides a stronger structure whose operation is more resistant to interruption by intentionally and unintentionally applied external forces. It is also capable of complete functioning while operating with low power. Other features and advantages of the invention will be apparent from the following more detailed description of the preferred embodiments, taken in conjunction with the accompanying drawings, which illustrate, by way of example, the principles of the invention.

BRIEF DESCRIPTION OF THE DRAWINGS

FIG. 1 is an elevational view of a turnstile made in accordance with the invention, with hidden portions shown in phantom lines;

FIG. 2 is a side sectional view of the preferred turnstile hub and associated structure of FIG. 1, taken along line 2—2;

DETAILED DESCRIPTION OF THE PREFERRED EMBODIMENTS

Figure 3:
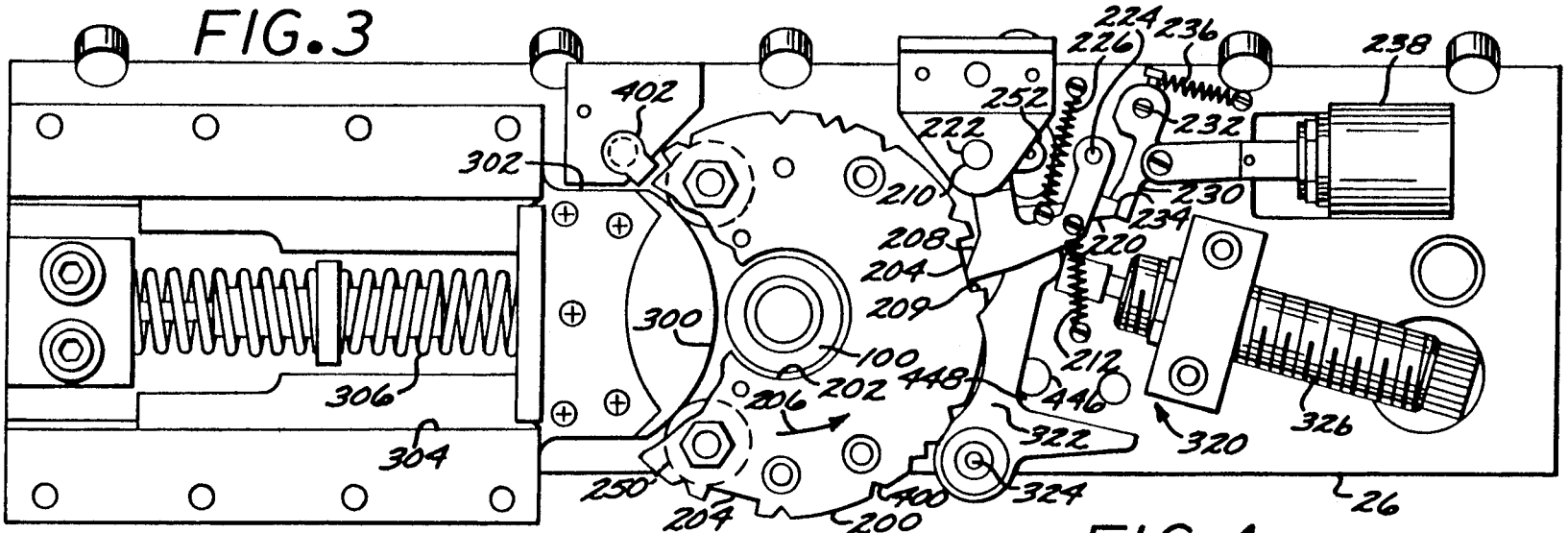
FIG. 3 is a plan view of the front side of the preferred turnstile hub mechanism of the invention.

FIG. 1 illustrates a turnstile 20, with a turnstile mechanism 22 supported therein. The mechanism 22 includes a turnstile hub 24 rotationally supported on a turnstile hub support 26. Turnstile barrier arms, preferably three turnstile barrier arms 28, are fixed to the turnstile hub 24 and extend outwardly therefrom. The turnstile hub support 26 is supported in and fixed to a turnstile housing 30.

The preferred form of the turnstile mechanism 22 and its associated structure is illustrated in FIG. 2. The turnstile hub support 26 is preferably a heavy steel plate. A cylindrical turnstile hub support shaft 100 is fixed to a bore 102 in the support 26, as with a press fit, by welding, or the like. The shaft 100 is not supported to the support 26 with a bearing or other mechanism which permits it to rotate with respect to the support 26. The opposite end of the shaft 100 from the end fixed to the support 26 is termed the support end 104.

The hub 24 is formed as a machined or cast steel piece having an interior cavity 106. The turnstile barrier arms 28 are bolted to the hub 24 with interior bolts 108, so that the barrier arms 28 cannot be removed without disassembling the turnstile mechanism 22. The support end 104 of the shaft 100 extends into the cavity 106.

A self-aligning ball bearing assembly 110 is disposed between an interior wall 112 of the hub 24 and the support end 104 of the shaft 100. One race 114 of the bearing assembly 110 is fixed to the interior wall 112 of the hub 24, and the other race 116 is fixed to the support end 104 of the shaft 100. The ball bearing assembly 110 permits the hub 24 to smoothly rotate upon the shaft 100.

This approach to supporting the turnstile hub 24 is superior to prior approaches wherein the supporting shaft was rotatably mounted to the support plate. The present design is more compact, reducing the overall length of the turnstile mechanism. The housing 30 can therefore be made narrower, leaving more room in the aisles between housings where patrons pass. The bearing 110 may be larger and more rugged. The moment arm on the bearing 110 of loads exerted on the turnstile arms 28 is smaller than in the prior approach.

A ratchet plate 200 is bolted to the back side of the hub 24. The rotational movement of the hub 24 about the shaft 100 is controlled through the ratchet plate 200. FIG. 3 illustrates in plan view the portion of the mechanism 22 that interacts with the ratchet plate 200, with the hub 24 removed so that that the mechanism may be seen more clearly.

The ratchet plate 200 is a generally circular piece of steel plate about ½ inch thick having a series of cutouts and notches in its periphery, and a bore 202 therethrough to permit the shaft 100 to pass therethrough. In plan view, the ratchet plate 200 may be divided into segments having an n-fold rotational symmetry, where n is the number of barrier arms 28. Since in the preferred embodiment, there are three barrier arms 28, the ratchet plate has a 3-fold symmetry. That is, the ratchet plate 200 may be rotated 120 degrees in either direction, and the resulting view is identical to that prior to the rotation. Thus, the rotation-limiting mechanisms discussed subsequently operate in an identical fashion for each of the three segments.

The ratchet plate 200 has three unidirectional pawl engagement cutouts 204 in the periphery thereof, spaced 120 degrees around the circumference of the plate 200. Rotation of the ratchet plate 200 (and thence the hub 24) in a fee-paid direction 206 is prevented by a unidirectional pawl 208 that engages a side 209 of the cutout 204, when the pawl 208 is in a first unidirectional pawl position as shown in FIG. 3.

The unidirectional pawl 208 is pivotably supported on a pivot support 210 so that it may pivot between the first unidirectional pawl position where the unidirectional pawl 208 engages the cutout 204 of the ratchet plate 200, thereby preventing rotation in the fee-paid direction 206, and a second unidirectional pawl position where the unidirectional pawl 208 does not engage the cutout 204 of the ratchet plate 200, thereby permitting rotation in the fee-paid direction (as well as in the opposite, or exit direction). A spring 212 biases the unidirectional pawl 208 toward the first unidirectional pawl position, shown in FIG. 3. Thus, the unidirectional pawl 208 normally engages the ratchet plate 200 and prevents it and the hub 24 from rotating in the fee-paid direction 206. The unidirectional pawl 208 can be moved out of engagement to permit rotation.

When the barrier arm 28 has no force against it, the unidirectional pawl 208 can be easily moved from the first to the second unidirectional pawl position. However, if a force is applied against the barrier arm 28 to try to force rotation of the hub 24 in the fee-paid direction, the unidirectional pawl 208 can be jammed against the side 209 of the cutout 204, so that it cannot be moved to the second position. If the unidirectional pawl 208 were directly driven by a solenoid triggered by payment of a fare, and if the force on the barrier arm 28 were maintained after the solenoid were deenergized, the patron would be denied entrance to the fee-paid area even though a fee had been paid. One approach to solving this problem would be to use a driving solenoid so powerful that it could overcome any restraining force, but such a solenoid would not be operable on battery power and would be expensive. The latching mechanism described next solves the problem of denial of admission in these circumstances, while permitting the use of a small, low-power solenoid.

A drive arm 220 is pivotable supported from a pivot 222 so that it can pivot between a first drive arm position and a second drive arm position. In the first drive arm position, the drive arm 220 permits the unidirectional pawl 208 to rest in the first unidirectional pawl (hub engaged) position. In the second drive arm position, the drive arm 220 engages the unidirectional pawl 208 and forces it toward the second unidirectional pawl position (hub unlocked) position. The preferred approach for achieving engagement is to mount the unidirectional pawl 208 at a slightly greater distance from the support 26 than the drive arm 220, and to extend a drive rod 224 from the pawl 208 to the plane of the drive arm 220. A strong drive arm spring 226 biases the drive arm 220 toward the drive arm second position, so that, if not otherwise restrained, the drive arm 220 would naturally force the unidirectional pawl 208 toward the second or hub unlocked position. The strength and position of the drive arm spring 226 are selected so that the force of the spring 226 overcomes the force of the spring 212 when the drive arm 220 engages to the pawl 208, forcing the pawl 208 out of contact with the ratchet plate 200.

A latching arm 230 is pivotably supported from a pivot 232, so that it can pivot from a first position wherein the drive arm 220 engages a shoulder 234 on the latching arm 230 to maintain the drive arm 220 at its first position, to a second position where the drive arm 220 does not engage the shoulder 234. A spring 236 biases the latching arm 230 toward its first or latching position. A latching solenoid 238 is connected to the latching arm 230. When the solenoid 238 is not energized, the latching arm 230 is permitted to rest in its first position, latching the drive arm 220 to its first position so that the unidirectional pawl 208 engages the ratchet plate 200 and prevents rotation of the hub 24 in the fee-paid direction. When the solenoid 238 is energized, the latching arm 230 is pulled to its second position, the drive arm 220 is released to move to its second position so that the unidirectional pawl 208 is moved out of engagement with the ratchet plate 200, thereby permitting rotation of the hub 24 in the fee-paid direction.

By having the solenoid 238 operate the latching arm 230 rather than the unidirectional pawl 208 directly, a small solenoid 238 may be used. The solenoid need only overcome the spring force of the spring 236, not any portion of the force that may be applied by the person against the barrier arm 28. Stated otherwise, the solenoid 238 is mechanically isolated from externally applied forces, and therefore need not be sized to overcome possibly large external forces.

When someone is pressing against the locked turnstile barrier arm 28 as the solenoid 238 is operated, the unlatching is accomplished in a "one shot" manner. If the friction on the unidirectional pawl 208 is so large that it cannot pivot out of the cutout 204 under the available spring force even when unlatched, actual unlocking and movement does not occur until the force on the barrier arm is sufficiently reduced. Experience shows that the patron who is pressing against the barrier arm 28 is likely to release the pressure by jiggling the arm in the event that it does not operate. The jiggling produces at least a momentary reduction in the force against the barrier arm 28, so that the pawl 208 can move under the action of its spring 212, the ratchet plate 200 is unlocked, and the barrier arm 28 operates. Because of the unlatching approach of the invention, the solenoid need not be continuously operated to achieve synchronization with the jiggling—the latch is released with one solenoid operation and no further operation is required.

The latching mechanism must be reset as the patron passes through the turnstile, to prepare it for the next patron. Resetting is accomplished by one of three cams 250 mounted below the ratchet plate 200. The cams 250 are preferably steel cylinders rotationally mounted at 120 degrees apart around the circumference of the ratchet plate 220, and at locations separated by about 15 degrees from the cutouts 204 in the exit direction.

A reset arm 252 is rotationally mounted on the unidirectional pawl pivot support 210. A coil spring (not shown) biases the reset arm 252 so that it encounters the cam 250 as the ratchet plate 200 is rotated in the fee-paid direction. The reset arm 252 includes a cam-following surface that rides on the surface of the cam 250, causing the reset arm 252 to rotate against the spring force. A projection on the reset arm 252 engages the drive arm 220 (which at this time is in its second position that forces the unidirectional pawl out of contact with the ratchet plate 200), and pushes the drive arm 220 against the biasing force of the spring 226 back toward the first drive arm position. When the drive arm reaches the drive arm first position, the spring 236 pulls the latching arm 230 back to its first position (the solenoid 238 having been deenergized), latching the drive arm 220 in its first position. This action permits the unidirectional pawl 208 to move back toward its first position under the biasing force of the spring 212, but it does not reach the first position because it rides upon the surface of the ratchet plate 200. When rotation of the hub 24 and the ratchet plate 200 reach the point that the next cutout 204 is moved into position to engage the pawl 208, the spring 212 pulls the pawl 208 into the cutout 204 and the ratchet plate 200 is locked into this position.

It is important to bias the entire ratchet plate 200, and thence the turnstile hub 24, to one of three "home" positions whereat one of the barrier arms 28 extends horizontally outwardly from the turnstile housing 30, as shown in FIG. 1. This biasing of the ratchet plate 200 is achieved with a spring-loaded centering cam follower 300 that rides on the cams 250. The centering cam follower 300 is a convexly shaped piece of urethane fixed to a support block 302. The support block 302 slides in a track 304 in the support 26, the track 304 extending radially outwardly from the center of the ratchet plate 200. A strong spring 306 is fixed at a distal end 308 to the support 26, and at the other end to the support block 302. The spring 306 is initially slightly loaded in compression, so that the centering cam follower 300 is forced against the cams 250. When the ratchet plate 200 is at the home position as shown in FIG. 3, the centering cam follower 300 is at a point of maximum length of the spring 306 between two of the cams 250. As the ratchet plate 200 is rotated in either direction away from the home position, the centering cam follower 300 rides on the cam 250, forcing the support block 302 outwardly against the spring force of the spring 306. The person who is turning the barrier arm 28 therefore must exert a force to make the arm turn. When the rotation of the ratchet plate 200 reaches a point half way to the next home position (the 60 degree location), the centering cam follower 300 rides over the top of the cam 250 and down the other side toward the next home position. The ratchet plate 200, hub 24, and barrier arm 28 therefore move toward that next home position without aid of the patron as the spring 306 releases its stored energy.

To ensure centering in the home position and to control the speed at which the hub 24 approaches the home position, a hydraulic damper 320 is provided. The damper 320 includes a damper arm 322 supported on a damper pivot 324. The surface of the damper arm 322 adjacent the ratchet plate 200 rides on the cam 250, and is positioned to ensure that the cam 250 will position itself in precisely the home position. An adjustable spring-loaded hydraulic damper 326 having a micrometer-type adjustment presses against the other side of the damper arm 322. Increasing the pressure exerted by the damper 326 against the damper arm 322 slows the approach of the ratchet plate 200 and the hub 24 to the home position.

As discussed previously, the ratchet plate 200 has three unidirectional pawl engagement cutouts 204 in its periphery. Additionally, there are a number of notches 400 cut into the periphery of the ratchet plate 200 at various locations thereon. In the preferred approach with cutout 204 at a reference location of 0 degrees and another at a reference location of 120 degrees, notches are centered at at least 15 and 60 degrees around the periphery between the two cutouts 204.

A bidirectional pawl 402 is rotationally mounted on a pivot support shaft (not shown) that extends upwardly from the pivot support 26. The pivot support shaft for the bidirectional pawl 402 is located at a position 120 degrees around the periphery of the ratchet plate 200 from the point of engagement of the unidirectional pawl 208 to the ratchet plate 200. The bidirectional pawl 402 is a keyhole shaped piece of steel spaced from the ratchet plate 200 so that the pawl 402 can engage the notches 400. As the ratchet plate 200 and hub 24 are rotated in the fee-paid direction or the exit direction, the bidirectional pawl rides over the surface of the periphery of the ratchet plate 200. However, if there is an attempt to change the direction of rotation, the bidirectional pawl 402 engages the next notch 400 that it encounters and prevents such rotation in the opposite direction. Thus, the bidirectional pawl 402 provides a mechanism for preventing persons from defeating the turnstile mechanism to gain admission without paying the required fee by backcocking. In backcocking, the person pulls the barrier arm 28 in the exit direction for some amount of rotation (typically about 60 degrees), squeezes into the fee paid area through the the space between adjacent barrier arms, and then releases the barrier arm once inside the fee-paid area.

The permitted direction of rotation is established by the first direction of movement of the hub 24 from its "home" position. If the first movement (of more than about 15 degrees of rotation) of the hub 24 from the home position is in the fee-paid direction, then the anti-backcocking mechanism will prevent the hub 24 from being moved back toward the location from which it started. Conversely, if the first movement of the hub 24 from the home direction is in the exit direction, the anti-backcocking mechanism will prevent it from returning in the fee-paid direction.

Under some circumstances, the hub 24 may be moved in the exit direction more than 15 degrees but less than 60 degrees, and be locked at this position against returning to the nearest home position by the bidirectional pawl 402. A patron arriving at the turnstile may be confused as to how to proceed, because the patron expects to see the turnstile barrier arm 28 in the horizontal orientation corresponding to the home position. It is therefore desirable to be able to controllably release the reverse locking action of the bidirectional pawl 402, so that the ratchet plate 200 is forced back to the home position by the spring 306, in the manner discussed previously. The following discussion relates to a mechanism for controllably releasing the bidirectional pawl 402 using a small solenoid to achieve automatic zeroing of the ratchet plate 200 to the home position upon command.

Figure 4:
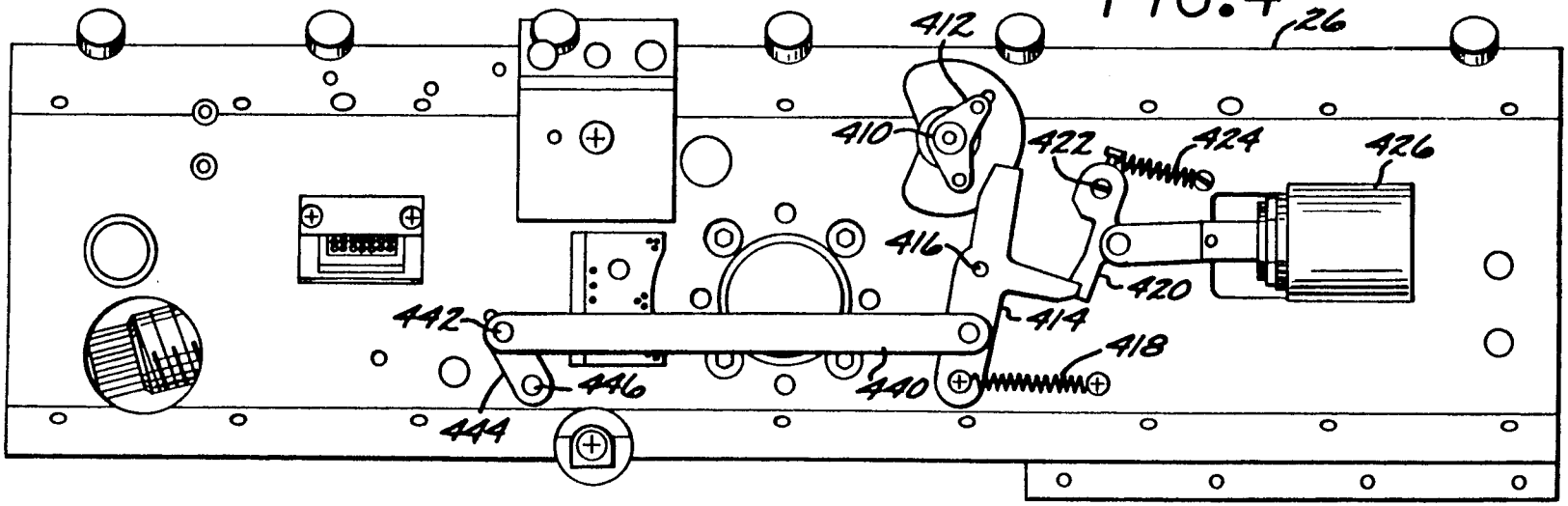
FIG. 4 is a plan view of the back side of the preferred turnstile hub mechanism of the invention.

Referring to FIG. 4, a view from the back side of the support plate 26, a shaft 410 upon which the bidirectional pawl 402 is mounted extends through the hub support plate 26 for back side access. This permits the automatic zeroing mechanism to be assembled on the back side, because there is insufficient space available on the front side illustrated in FIG. 3.

An angled zeroing arm 412 having the shape of a very shallow Y is fixed to the shaft 410 on the back side of the support 26. A pressure against the zeroing arm 412 causes the shaft 410 and thence the bidirectional pawl 402 to turn. The bidirectional pawl 402 is rotated so that it cannot engage any of the notches 400 to lock the hub 24 against backcocking. As a result, the previously described biasing mechanism and damping mechanism come into operation, and the ratchet plate 200 and hub 24 automatically rotate to the home position.

Pressure is controllably applied to the zeroing arm 412 by a zeroing drive arm 414. The zeroing drive arm 414 is pivotably mounted on a pivot 416, to move from a zeroing drive arm first position wherein it does not influence the zeroing arm 412, to a zeroing drive arm second position wherein it applies zeroing pressure against the zeroing drive arm 414. A spring 418 biases the zeroing drive arm 414 toward the zeroing drive arm second position.

The zeroing drive arm 414 is releasably and normally held in the zeroing drive arm first position by engagement with a shoulder on a zeroing latching arm 420. The zeroing latching arm 420 is pivotably mounted on a pivot 422, and is biased toward a zeroing latching arm first position, wherein it engages the zeroing drive arm 414, by a spring 424. A zeroing solenoid 426 is attached to the zeroing latching arm 420. When the zeroing solenoid 426 is not energized, the zeroing latching arm 420 remains in its first position, the zeroing drive arm 414 remains latched in its first position, and there is no zeroing influence on the bidirectional pawl 402. When the zeroing solenoid 426 is energized, the zeroing latching arm 420 is pivoted against the force of the spring 424 to a second position wherein it does not engage the zeroing drive arm 414, the zeroing drive arm 414 pivots to its second position under the influence of the spring 418, the zeroing drive arm 414 engages the zeroing arm 412, and the bidirectional pawl 402 is pivoted away from the ratchet plate 200. Automatic zeroing of the ratchet plate 200 and the hub 24 to the home position results. The zeroing solenoid 426 may be energized manually by an operator or under computer control when sensors detect an out-of-home condition.

The use of the latching approach in the automatic zeroing system has the same advantages as described previously for the latching approach in the operation of the unidirectional pawl 208. Pressure against the ratchet plate 200 is not transmitted to the solenoid 426, and therefore a small, low-power consumption solenoid may be used. If the force exerted by the notches 400 of the ratchet plate 200 against the bidirectional pawl 402 is too great to permit the bidirectional pawl 402 to pivot out of contact with the notches 400, the one-shot release of the latching leaves the system in a condition such that, as soon as the force is reduced sufficiently, pivoting of the pawl 402 and zeroing occur. An out-of-home condition normally is not accompanied by significant pressure against the barrier arm 28, however.

After automatic zeroing has occurred, the zeroing drive arm 414 must be reset to its first position engaging the shoulder on the zeroing latching arm 420. Resetting is conveniently accomplished by a reset movement from the damper arm 322. A zeroing reset arm 440 is connected at one end to the zeroing drive arm 414, and pivotably supported at a pivot 442 at the other end. A zeroing reset arm extension 444 extends from the pivot 442 with a finger that engages the reset arm 440. A pin 446 extends upwardly from the extension 44 through a slot 448 in the support plate 26. The pin 446 extends through the plate 26 at a location adjacent the damper arm 322. When the damper arm 322 rides upwardly on the cam 250, it pushes against the pin 446 so that the pin 446 moves in the slot 448. This movement is transmitted to the reset arm 440, and thence to the zeroing drive arm 414 to force it to the first or latching position. Latching by the latching arm 420 occurs automatically, unless the solenoid 426 is energized.

The present approach has provided important new capabilities not heretofore available in turnstile mechanism. First, the hub design is made more robust than was previously possible, giving it more resistance to damage from external loadings. Second, the design approach isolates electrical equipment used in unlatching release of locking pawls from mechanical forces exerted against the hub and/or barrier arms when release is being attempted. Small, low power solenoids may therefore be used for unlocking the rotational mechanism. The systems may therefore be operated under battery power when required. Moreover, the system is more reliable than prior designs, because the portions of the mechanism that are in direct connection with possible external forces can be made large, heavy, and robust, and therefore resistant to external forces and damage, while at the same time the electrical equipment is made small and low powered.

Although particular embodiments of the invention have been described in detail for purposes of illustration, various modifications may be made without departing from the spirit and scope of the invention. Accordingly, the invention is not to be limited except as by the appended claims.

What is claimed is:

1. A turnstile mechanism, comprising:

a turnstile hub support;

a turnstile hub having an interior cavity and turnstile arms extending therefrom;

a stationary turnstile hub support shaft fixed to the turnstile hub support and having a hub support end extending into the turnstile hub cavity;

a single self aligning bearing mechanism between the hub support end of the turnstile hub support shaft and an interior wall of the hub and disposed within the turnstile hub cavity, the bearing acting to support the turnstile hub from the stationary support shaft; and means for retaining the bearing mechanism, the means for retaining being disposed entirely within the interior cavity of the hub.

2. The turnstile mechanism of claim 1, wherein the bearing utilizes ball bearing elements.

3. The turnstile mechanism of claim 1, further including a ratchet plate mounted to the turnstile hub.

4. The turnstile mechanism of claim 1, wherein there are three turnstile arms extending from the turnstile hub.

5. A turnstile mechanism, comprising:

a turnstile hub support;

a turnstile hub having turnstile arms extending therefrom;

means for rotationally supporting the turnstile hub from the turnstile hub support;

a ratchet plate mounted to the turnstile hub, the periphery of the ratchet plate being divided into segments having a rotational symmetry corresponding to the number of turnstile arms with a home position for each segment, the periphery of the ratchet plate further having, within each segment, a unidirectional pawl engagement cutout; and means for locking the turnstile hub against rotation in a fee-paid direction and for controllably unlocking the turnstile hub to permit the turnstile hub to rotate in a fee-paid direction, the means for unlocking and for controllably unlocking including a unidirectional pawl movable between a first unidirectional pawl position wherein the unidirectional pawl engages the unidirectional pawl engagement cutout of the ratchet plate when the turnstile hub is in the home position, and a second unidirectional pawl position wherein the unidirectional pawl does not engage the unidirectional pawl engagement cutout of the ratchet plate, means for biasing the unidirectional pawl toward the first unidirectional pawl position, a drive arm movable from a first drive arm position wherein the drive arm permits the unidirectional pawl to remain at the first unidirectional pawl position, and a second drive arm position wherein the drive arm urges the unidirectional pawl toward the second unidirectional pawl position, and means for biasing the drive arm toward the second drive arm position, the force exerted by the drive arm acting upon the unidirectional pawl being greater than the force exerted by the means for biasing the unidirectional pawl; and latching means for retaining the drive arm in the first drive arm position and for controllably unlatching the drive arm to permit it to move toward the second drive arm position.

6. The turnstile mechanism of claim 5, wherein the means for rotationally supporting includes a stationary turnstile hub support shaft fixed to the turnstile hub support and having a hub support end thereof, and a bearing on the hub support end of the turnstile hub support shaft and acting to support the turnstile hub from the stationary support shaft.

7. The turnstile mechanism of claim 5, wherein there are three arms extending from the turnstile hub, and the ratchet plate has a three-fold rotational symmetry.

8. The turnstile mechanism of claim 5, further including means for biasing the turnstile hub toward a home position.

9. The turnstile mechanism of claim 5, further including means for locking the turnstile hub against backcocking in an exit direction and for controllably unlocking the turnstile hub to permit the turnstile hub to move toward a home position.

10. The turnstile mechanism of claim 9, wherein the means for locking includes a bidirectional pawl.

11. A turnstile mechanism, comprising:

a turnstile support;

a turnstile hub having turnstile arms extending therefrom;

means for rotationally supporting the turnstile hub from the turnstile support;

a ratchet plate mounted to the turnstile hub, the periphery of the ratchet plate being divided into segments having a rotational symmetry corresponding to the number of turnstile arms with a home position for each segment, the periphery of the ratchet plate further having, within each segment, at least one bidirectional pawl engagement notch;

means for biasing the turnstile hub toward a home position;

means for locking the turnstile hub against backcocking in an exit direction and for controllably unlocking the turnstile hub to permit the turnstile hub to move toward a home position, the means for locking and for controllably unlocking including a bidirectional pawl movable between a first bidirectional pawl position wherein the bidirectional pawl does not engage one of the notches to a second bidirectional pawl position wherein the bidirectional pawl engages one of the notches, a zeroing drive arm movable between a first zeroing drive arm position wherein the zeroing drive arm does not engage the bidirectional pawl and a second zeroing drive arm position wherein the zeroing drive arm engages the bidirectional pawl to urge it toward the second bidirectional pawl position, and means for biasing the zeroing drive arm toward the second zeroing drive arm position; and latching means for retaining the zeroing drive arm in the first zeroing drive arm position and for controllably unlatching the zeroing drive arm to permit it to move toward the second zeroing drive arm position.

12. The turnstile mechanism of claim 11, wherein the means for rotationally supporting includes a stationary turnstile hub support shaft fixed to the turnstile hub support and having a hub support end thereof, and a bearing on the hub support end of the turnstile hub support shaft and acting to support the turnstile hub from the stationary support shaft.

13. The turnstile mechanism of claim 11, wherein there are three arms extending from the turnstile hub, and the ratchet plate has a three-fold rotational symmetry.

14. The turnstile mechanism of claim 11, further including means for locking the turnstile hub against rotation in a fee-paid direction and for controllably unlocking the turnstile hub to permit the turnstile hub to rotate in a fee-paid direction.

15. The turnstile mechanism of claim 11, wherein the means for biasing the turnstile hub toward a home position includes a cam mounted on the ratchet plate and a cam follower mounted to the turnstile support and biased against the cam.

* * * * *